US005471220A

United States Patent [19]

Hammers et al.

[11] Patent Number: 5,471,220

[45] Date of Patent: Nov. 28, 1995

[54] INTEGRATED ADAPTIVE ARRAY ANTENNA

[75] Inventors: David E. Hammers, Los Angeles, Calif.; Michael D. Conway, Roanoke, Va.

[73] Assignee: ITT Corporation, New York, N.Y.

[21] Appl. No.: 198,410

[22] Filed: Feb. 17, 1994

[51] Int. Cl.[6] ..... H01Q 3/24

[52] U.S. Cl. ..... 342/372; 343/700 MS

[58] Field of Search ..... 342/372, 380; 257/700, 728

[56] References Cited

U.S. PATENT DOCUMENTS

| | | | |
|---|---|---|---|
| Re. 32,369 | 3/1987 | Stockton et al. | 342/368 |
| 3,795,002 | 2/1974 | Nemit | 343/754 |
| 4,173,759 | 11/1979 | Bakhru | 342/382 |
| 4,581,614 | 4/1986 | LaCourse | 343/368 |
| 4,635,062 | 1/1987 | Bierig et al. | 342/372 |
| 4,893,126 | 1/1990 | Evans | 342/175 |
| 4,933,680 | 6/1990 | Shapiro et al. | 343/700 MS |
| 4,949,090 | 8/1990 | Tamii et al. | 342/173 |
| 4,965,605 | 10/1990 | Chang et al. | 343/700 MS |
| 4,967,201 | 10/1990 | Rich, III | 342/175 |
| 5,003,314 | 3/1991 | Berkowitz et al. | 342/152 |
| 5,115,245 | 5/1992 | Wen, et al. | 342/175 |
| 5,138,436 | 8/1992 | Koepf | 257/728 |
| 5,160,936 | 11/1992 | Braun et al. | 343/725 |
| 5,162,803 | 11/1992 | Chen | 342/372 |
| 5,198,824 | 3/1993 | Poradish | 343/700 |
| 5,218,368 | 6/1993 | Huruno et al. | 343/700 |
| 5,223,850 | 6/1993 | Branigan et al. | 343/771 |

OTHER PUBLICATIONS

McIvenna, Monolithic Phased Arrays for EHF Communications Terminals, 3–1988, p. 124.

Hietovla, Optical Technology for Microwave Applications V, 4–1991, p. 172.

*Primary Examiner*—Thomas H. Tarcza
*Assistant Examiner*—Dao L. Phan
*Attorney, Agent, or Firm*—Arthur L. Plevy

[57] ABSTRACT

An integrated active array antenna system is disclosed which comprises a "sandwich style" microwave packaging scheme that includes three principal layers: an antenna layer, a transceiver layer, and a beam forming sub array layer. These three layers are arranged in a coplanar geometry, with connections between the layers being in the form of microwave vias. Each transceiver module may be implemented in the form of a single Monolithic Microwave Integrated Circuit, and each beam forming sub array may be similarly implemented. The coplanar geometry and use of Monolithic Microwave Integrated Circuit technology provide for multibeam active array of very shallow physical depth.

21 Claims, 6 Drawing Sheets

INTEGRATED ADAPTIVE ARRAY ANTENNA

FIELD OF THE INVENTION

This invention relates generally to phased array communication systems and more particularly to phased array radars.

BACKGROUND OF THE INVENTION

The advantages of phased array systems are well known in the art of communication and radar systems design. Phased array antennas are constructed with a multiplicity of independently controllable transceivers and antennas. Each transceiver has a transmit path and a receive path and is connected to one or more of the array elements of the array antenna system. The multiple transceiver arrangement of the phased array allows the designer to incorporate into the system a means for independently controlling the signals that are transmitted and received by each transceiver.

By adjusting the phase and amplitude of these signals, a system operator can change the operating characteristics of the system. For example, the width of the electromagnetic beam transmitted from a phased array system can be made broader or narrower by selective phase shifting of the signals transmitted by the individual transceivers. Thus, a phased array system employing variable phase shifters, and a means to control those phase shifters, can have its beamwidth varied without changes to the system hardware. Phased array antenna systems are described in detail in the following references: *Radar Handbook,* edited by Merrill Skolnik, 2d edition, published by McGraw Hill, Inc. (1990) (see Chapter 7 -9+entitled "Phased Array Radar Antennas" by Theodore Cheston and Joe Frank.); *Antenna Theory: Analysis and Design,* by Constantine A. Balanis, published by Harper & Row, Inc. (1982) (see Chapter 6 entitled "Arrays: Linear, Planer, and Circular"); *Antenna Theory and Design,* by Warren Stutzman and Gary Thiele, published by John Wiley & Sons, Inc. (1981) (see Chapter 3 entitled "Arrays", especially section 3.7 entitled "Phased Arrays").

A typical arrangement of transceiver and antenna elements of a phased array antenna system is shown in FIG. 1. In that figure, a phased array system having three transceivers 2 is shown. Each transceiver is connected to one of three radiating elements 3. The transceivers 2 include the following elements: circulators 4, phase shifters 5, transmission amplifiers 6, receiver preamplifiers 7, trimming attenuators 8, and RF switches **8*a*. Control signals 9 are shown only for the first transceiver. When the system is operating in the transmit mode the switches 8*a* are set to guide the RF signal down the transmit path of the transceivers 2. The phase shifters 5 are set to the desired transmit phase and the attenuators 8 are set to the desired transmit attenuation, the settings for each transceiver being independent of the settings of the other transceivers. The transmit signal is then amplified by the transmit amplifiers 6 before being radiated from the elements 3. In the receive mode, the circulators 4 and the switches 8*a* guide the received signal down the receive path of the transceivers 2. The signal is amplified by the receive preamplifiers 7 before being attenuated by trim attenuators 8 and being phase shifted by phase shifters 5. As in the transmit mode, the trim attenuators 8, and the phase shifters 5** may be independently set for each transceiver. It is this ability to independently set the modules that gives rise to many of the advantages of phased array systems.

The advantages realized by the phased array structure find numerous applications in both military and commercial settings. The variable set of operating characteristics that the phased array offers, such as the ability to change beamwidths and gain direction without changing the system hardware or mechanically rotating the aperture, can greatly increase the effectiveness of a military radar. A narrower beamwidth will enable the radar operator to locate a target with greater precision in a particular direction. A broader beamwidth will allow the same operator to find a target more quickly. Ideally the operator would like to begin his search with a broad beamwidth, then upon finding a target, pinpoint the target's position by changing to a narrower beamwidth and a specific direction. A variable beamwidth also offers advantages when employed in a non-military setting.

While phased array systems that realize the advantages of the phased array architecture have been built, there is a desire to make these arrays smaller so that they can be adapted for use in airborne and portable systems.

Traditional phased array radars are bulky complex systems in which azimuth and elevation scanning is accomplished through switching energy and phase by controlling bulky independent phase shifters that are located at each radiating element. The energy is supplied to the antenna by a centralized transmitter—driving it with a low duty cycle, high peak power RF signal which is split and supplied to each phase shifter, each such split and phase-shifted signal being thereafter routed to one or more antenna array elements for transmission. The return signals are sensed by the array elements, operated on by the phase shifters and collected in a centralized receiver for subsequent processing. High Power Systems (e.g. X-Band) using this technology might weigh more than 5 thousand pounds and occupy large structures (greater than 100 $ft^3$) to house the high power electronics and externally mounted antenna. This combination results in a microwave weight-x-volume product greater than 500,000 lbs.-$ft^3$.

Active phased arrays reduce the bulk of the above type systems by including miniature solid state RF Transmit/Receive (T/R) modules consisting of amplifier chips for transmit power gain, receiver amplifier chips for receiver gain, and a solid state phase shifter. Low level energy is supplied to the antenna by a high duty cycle, low peak power RF signal which is split and supplied to each T/R element. The T/R modules, while miniaturized, are still complex structures, each consisting of numerous interconnected microwave chips—usually Gallium Arsenide (GaAs) based monolithic microwave integrated circuits (MMICs), deposited on various types of substrates and typically housed in a ceramic or aluminum carrier. This module is typically, 1 inch×0.5 inches×3 inches and weighs about 2 ounces—depending on the operating microwave frequency of the radar. A ten thousand element antenna (X-Band) using these modules would also include a cooling system, beam forming feeds, and power distribution network. Such a system would typically weigh on the order of 2500 lbs and be about 20 $ft^3$ in volume. This results in a weight-x-volume product of 50,000 lbs.-$ft^3$ which is still too large for future stealthy aircraft, surface effect ships, or small tactical ground vehicles.

Two examples of phased arrays which include miniature solid state RF T/R modules are the Westinghouse AN/APQ-164 and the UK's naval phased array (MESAR). In the MESAR system individual GaAs MMIC chips, including a digitally controlled FET phase shifter, are all assembled on an alumina substrate, this technique providing the optimum in cost and yield with the current state of GaAs technology. The Westinghouse system employs 1526 ferrite phase shifters in plug-in module form. The latest developments of this system involve experimentation with complete plug-in GaAs T/R modules.

In overcoming these disadvantages of prior-art systems, the present invention achieves a dramatic reduction in the size and complexity of an active phased array antenna system. This result is accomplished in part through the use of a novel single chip T/R module developed through the use of microwave monolithic integration. Such a single chip T/R module can be realized in a package size of no more than 50 $mm^2$, thus providing a major reduction in the weight-x-volume product for an array antenna system using such modules. This provides a real breakthrough in the field deployment of advance technology radar systems.

SUMMARY OF INVENTION

It is an object of the present invention to provide a phased array antenna system that will realize all the traditional advantages of a phased array system while being both highly portable and capable of being conformed to the surface shape of any vehicle in which it is placed.

This object is achieved by integrating the essential elements of the array so that they are contained in a single plane having a very narrow physical depth. The coplanar elements of the array include: a plurality of antennas; a plurality of transceivers, each one fabricated as a single integrated circuit; a means for shaping the transmit and receive beams; and a means for processing received signals and for providing control signals. The passage of signals between the layered elements is accomplished through the use of microwave vias. By using this "sandwich style" microwave packaging scheme an array having a physical depth that is much narrower than that of previously realized arrays can be constructed.

An advantage of the invention over previously designed phased array systems is its applicability to conformal radar systems. Due to the coplanar packaging and light weight of the invention it is ideal for use in ships, planes, and other vehicles. For example, the invention can be placed in the "skin" of a fighter plane without having to adapt the fighter plane's shape and thereby reduce its aerodynamic efficiency. Furthermore, it could be placed on all exterior surfaces of the fighter plane in order to provide 360 degree detection capability, as compared to the limited detection capability of a "nose radar".

In a further embodiment of the invention a protective radome, a cooling membrane, an adaptive beam processor, and a signal processor may be added. The radome could be the outer surface of a vehicle if the invention is employed in a conformal configuration. The cooling membrane may be used to dissipate any heat that may be generated by the active components of the transceivers. The adaptive beam processor may be used to implement an adaptive interference cancellation algorithm, such as the Gram-Schmidt algorithm. The signal processor may perform additional signal processing functions on any received signals. The signal processor and beam processor may also operate to shape the transmit and receive beams.

DETAILED DESCRIPTION

Figure 1:
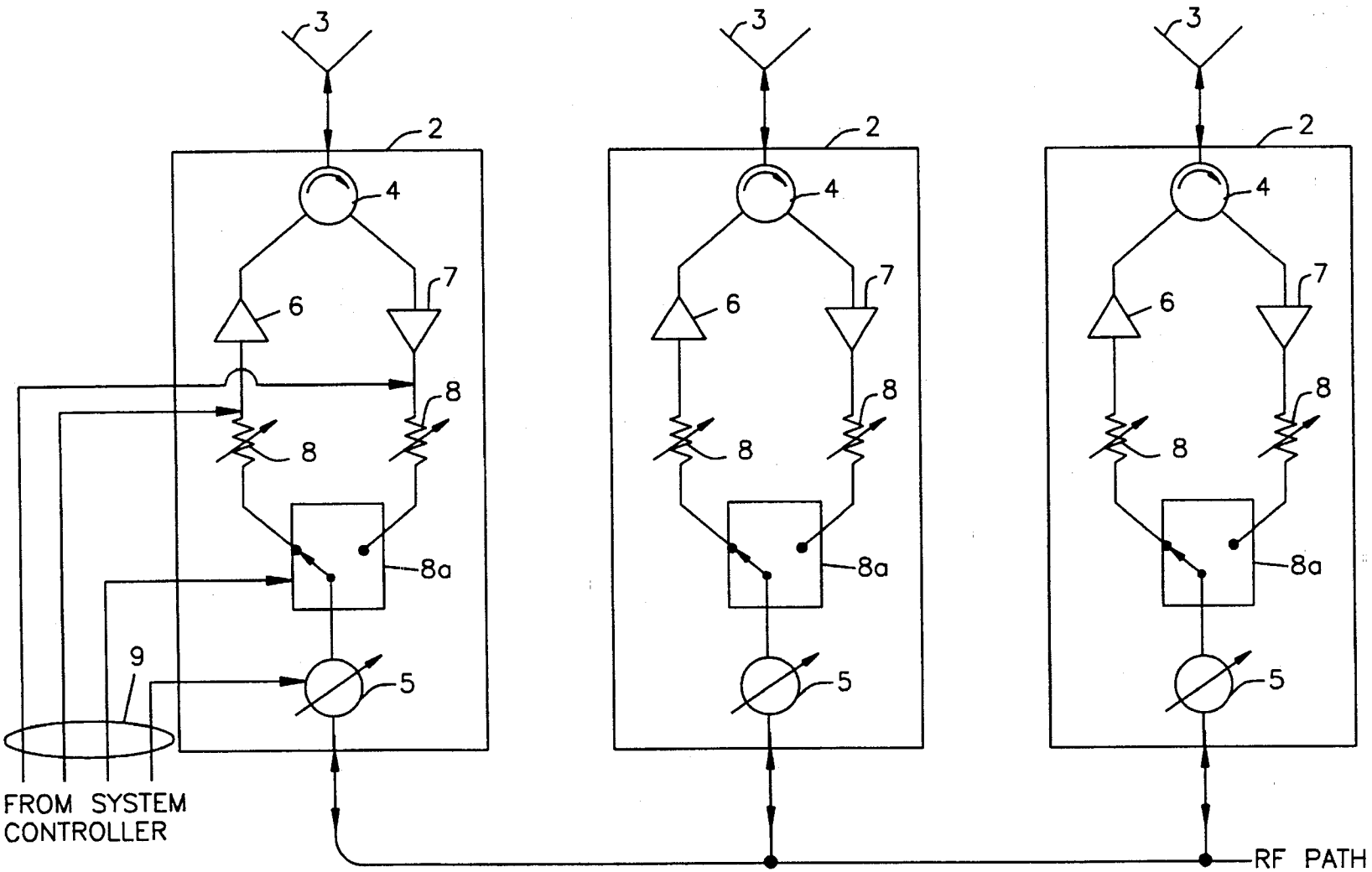
FIG. 1 (PRIOR ART)
FIG. 1 is a schematic diagram of a typical prior-art phased array antenna system.
Figure 2:
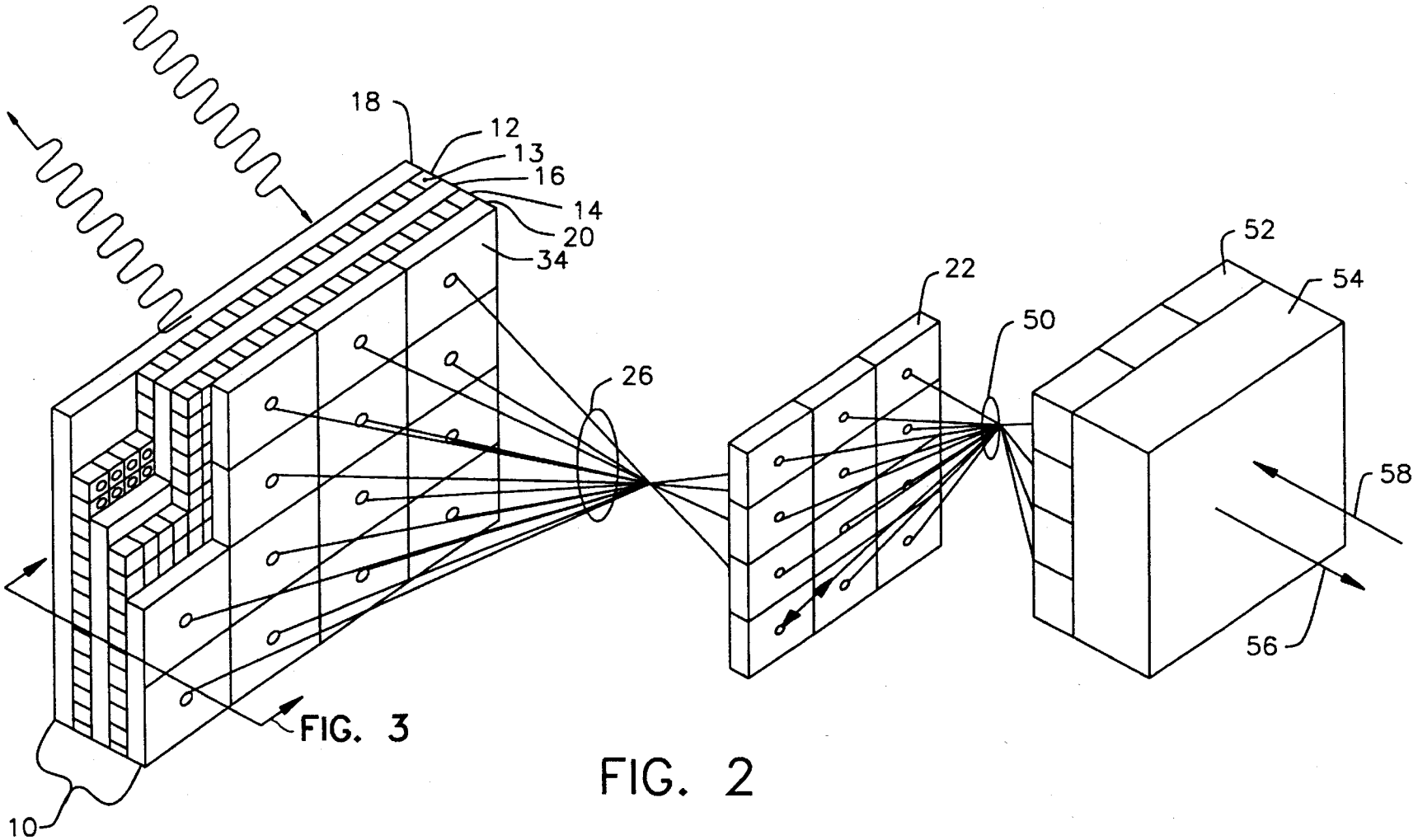
FIG. 2 is a perspective view of an embodiment of the integrated active array antenna according to the present invention.

Referring now to FIG. 2, there is shown a perspective view of a preferred embodiment of the integrated active array antenna according to the present invention. The embodiment in FIG. 2 includes a coplanar section 10 composed of several coplanar layers. An antenna layer 12 makes up one layer of the coplanar section 10. The antenna layer 12 consists of a plurality of antennas 13 through which the system transmits and receives electromagnetic energy. Each of the plurality of antennas 13 that make up the antenna layer may be in the form of thin metallic conductors bonded to a thin grounded dielectric substrate. The thin metallic conductor would typically have some regular shape such as rectangular, circular, or elliptical.

A transceiver layer 14, consisting of a plurality of transceivers, makes up a second layer of the coplanar section 10. The transceivers have a dual function: to generate electromagnetic energy for transmission through the antennas, and to receive electromagnetic energy picked up by the antennas from the outside world. Preferably, each transceiver is fabricated as a single MMIC chip. Several advantages are realized by the incorporation of such transceiver chips in a phased array system. The chips would be readily interchangeable, simplifying system maintenance. The system will be more resilient because of a reduction in the overall number of components as well as a reduction in the number of connections between components. Also, by reducing the size of the individual transceivers to that of a single MMIC chip, a greater number of such transceivers can be incorporated into a system of given size, thereby decreasing the load on each module and making the system less sensitive to the failure of any one module.

Between the antenna layer 12 and the transceiver layer 14 there may be a cooling membrane 16. The cooling membrane 16 will be used to absorb heat generated by the excitation of the antennas and transceivers. Somewhat similarly, an electromagnetically transparent radome layer 18 may be affixed to the antenna layer 12 such that it protects the antennas and other system elements from the environment in which the system is operating, yet allows for the passage of electromagnetic energy between the antennas and the outside world. It will be understood, however, that, while such an cooling membrane and/or a radome layer may enhance operating efficiency or increase the level of physical security, they are not essential to the operation of the invention.

A beam forming layer 20, consisting of one or more beam forming sub arrays 34, is affixed to the transceiver layer 14, making up another layer of the coplanar section 10. Each one of the beam forming sub arrays of the beam forming layer 20 is coupled to at least one of the transceivers of the transceiver layer 14. In a preferred embodiment the beam-forming sub arrays will also be implemented in form of independent MMIC chips. In this manner the interchangeability and resiliency advantages of a multiple chip arrangement will be realized.

Figure 3:
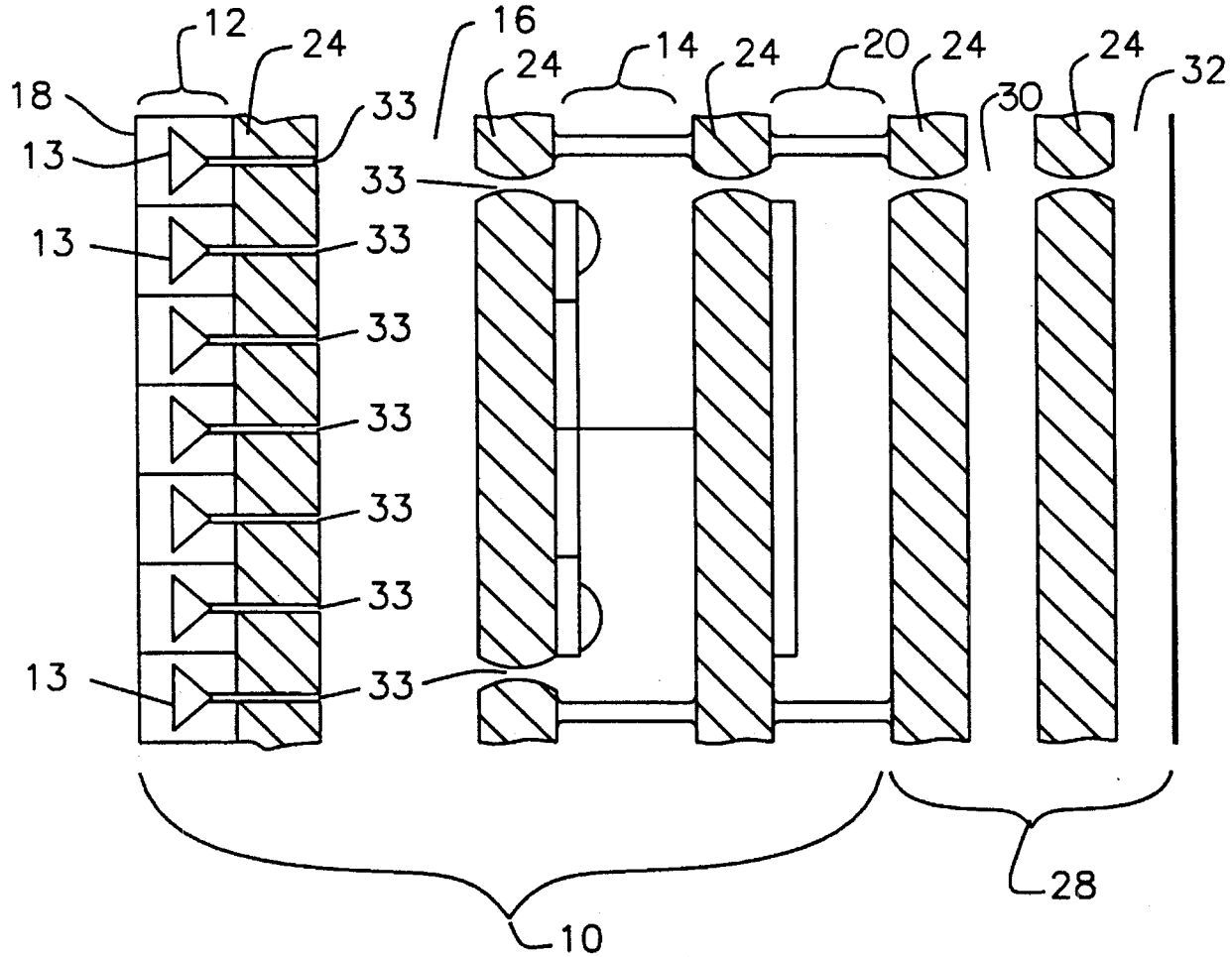
FIG. 3 is a cut-away side view of an integrated active array antenna according to the present invention showing the coplanar arrangement of antennas, transceivers, sub arrays, and other operational components.

Referring to FIG. 3, it can readily be seen that the structure of the coplanar section 10 is composed of several layers affixed to one another by a plurality of connecting layers 24. The connecting layers 24 are composed of a material that provides sufficient structural rigidity yet allows for the efficient passage of signals between layers. The outermost layer of coplanar section 10, as depicted in FIG. 3, is the radome layer 18. Continuing from radome layer 18 inward, the other elements of the coplanar section are, respectively: the antenna layer 12, the cooling membrane 16, the transceiver layer 14, and the beam forming layer 20. The passage of signals between the antenna layer 12, transceiver layer 14, and beam forming layer 20 may be achieved through a plurality of microwave vias 33.

Also shown in FIG. 3 are a plurality of additional coplanar layers 28 that are added to the coplanar section 10 to realize a preferred embodiment of the invention. Among the elements comprising these additional coplanar layers 28 is a DC feed layer 30 which is comprised of a DC power distribution network for supplying DC power to the transceivers of the transceiver layer 14 and to the beam forming sub arrays 34 of the beam forming layer 20. A second additional layer is an RF feed layer 32 which is comprised of an RF distribution network for channeling RF energy to the beam forming layer 20 when the system is transmitting. The RF feed layer 32 can also be used to channel RF energy from the beam forming layer 20 when the system is receiving. The passage of signals between the RF feed layer 32 and the layers of the coplanar section 10 may also be achieved through microwave vias 33. The DC feed layer 30 and RF feed layer 32 may be affixed to the coplanar section 10 by means of connecting layers 24.

Figure 4:
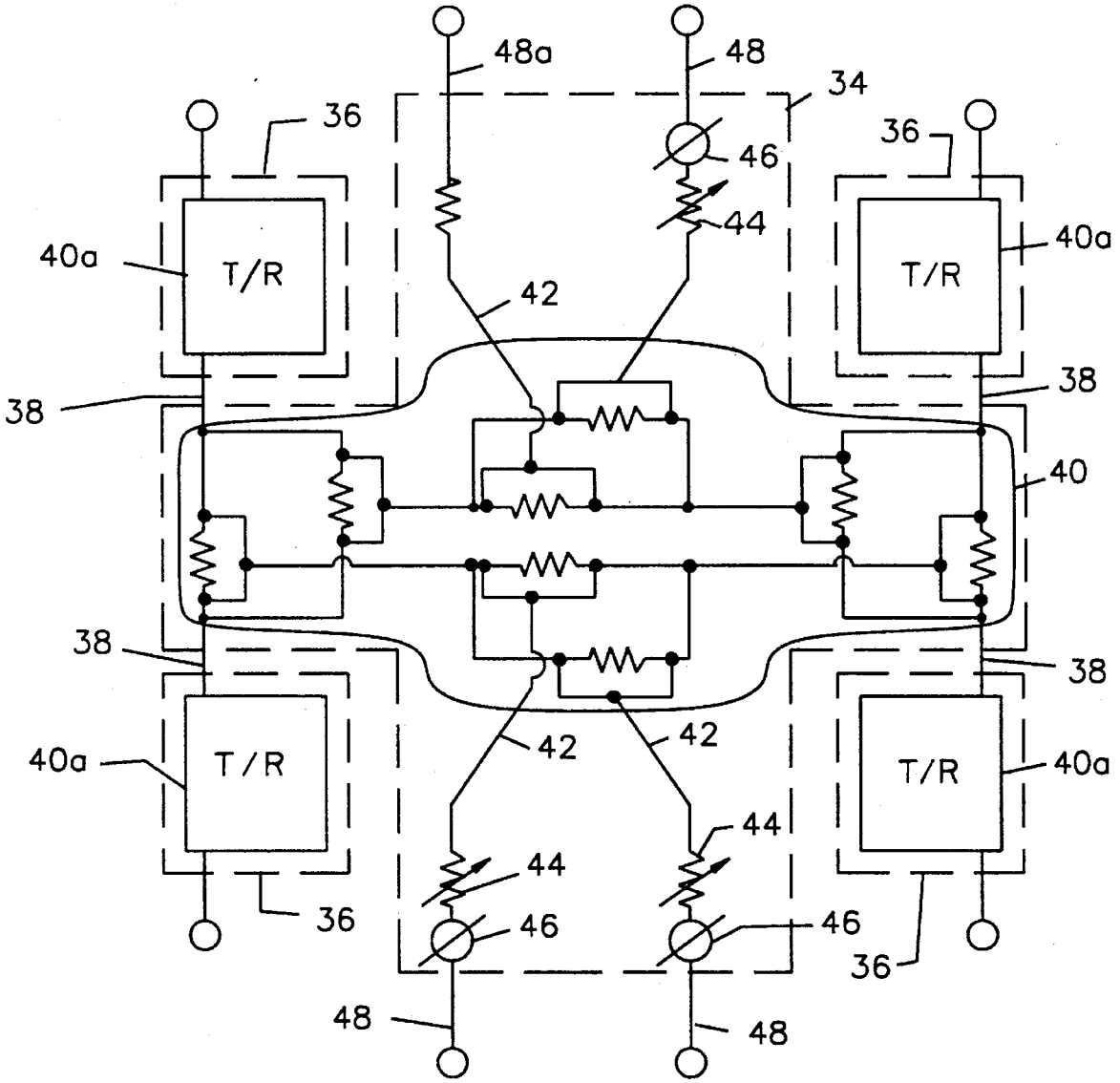
FIG. 4 is a schematic diagram of a beam forming sub array coupled to 4 transceivers.
Figure 4A:
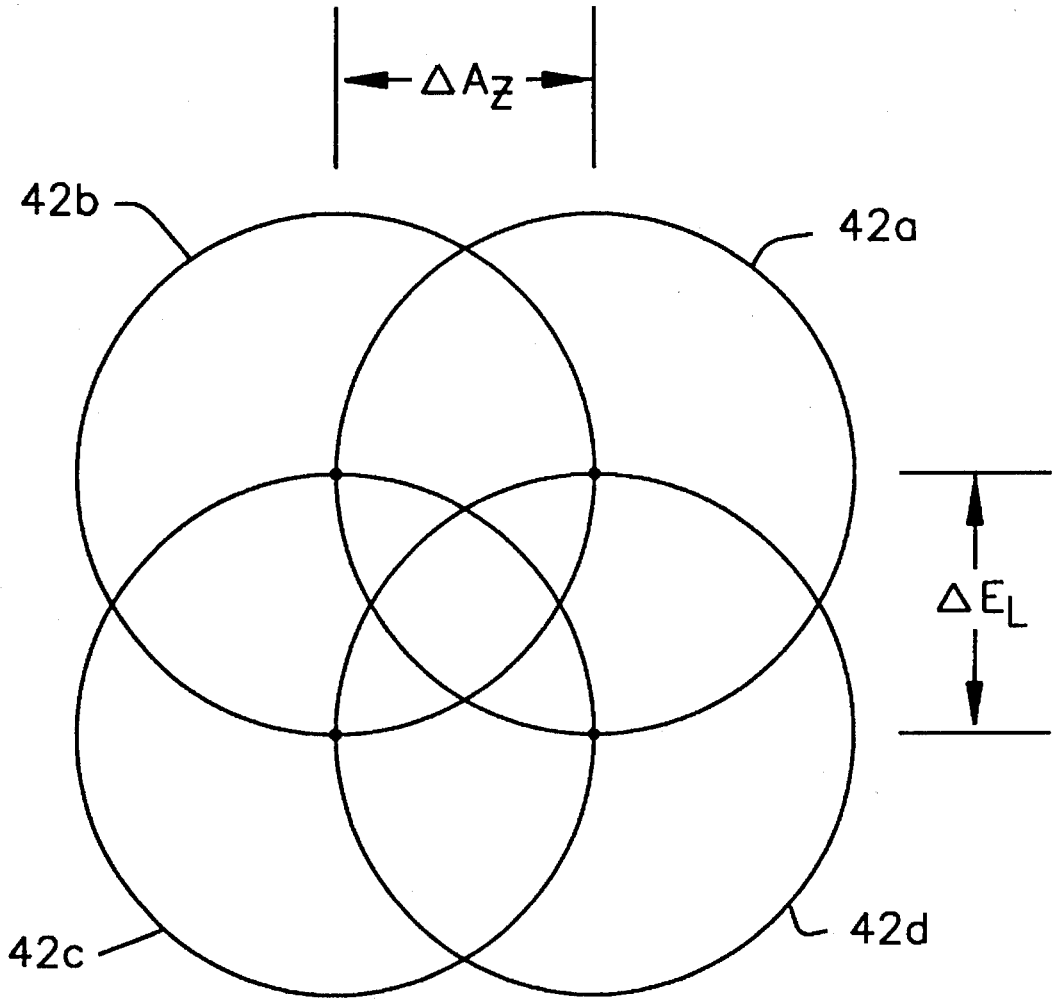
FIG. 4*a* is an exemplary representation of beams produced from the beam forming sub array shown in FIG. 4.

With reference to FIG. 4, it can be seen that, in a preferred embodiment of the invention, each beam forming sub array 34 is coupled to four transceivers 36 through four sub array transceiver ports 38. When the system is receiving, received electromagnetic signals are passed from the transceivers 36 to the beam forming sub array 34 and are selectively combined by a coupling network 40. Four signals 42 are derived from the coupling network 40. Three of these signals will be attenuated, by attenuators 46, and phase shifted by phase shifters 44. The three conditioned signals and the fourth signal, which is unconditioned, will form four beams 42*a*, 42*b*, 42*c*, 42*d* each offset by $\Delta E_L°$ and $\Delta A_Z°$ from the reference beam 42*d* at port 48*a* as shown in FIG. 4*a*. Thus, four beams are formed, one at each port 48 and offset in angle from the beam at port 48*a* by the phase shifters 46. Note that the array of beams shown in FIG. 4*a* provides the system with the ability to include two axis monopulse angle measurement for target location plus added search speed for target location.

The I/O ports are in turn coupled to a plurality of adaptive beam processors 22, as is depicted in FIG. 2. In the illustrated embodiment of the invention, such coupling of the I/O ports 48 to the adaptive beam processors 22 will be achieved through a fiber optic network 26 which is comprised of a plurality of fiber optic transmission lines, as illustrated in FIG. 2. It is to be understood, however, that the invention is not limited to such a quad-based processing sub-array and that a multiplicity of coupling configurations for coupling the beam forming subarrays and the transceivers—including one-to-one, are within the scope of the invention. Similarly, the use of a fiber optic network for coupling the I/O ports of the beam forming sub arrays to the adaptive beam processors is merely illustrative of a variety of known transmission media which may be employed for such coupling.

Referring further to FIG. 2, the flow of a received electromagnetic signal as it would occur in a preferred embodiment of the invention will hereafter be described. Signals incident upon the antennas 12 are coupled to the transceivers 14, where they are operated on in a conventional manner. The signal outputs from the transceivers then travel to the beam forming sub arrays 20, and after operation by such sub arrays, output signals therefrom are then coupled to the adaptive beam processors 22 by way of a fiber optic network 26. Such a fiber optic coupling network, including electrical-to-optical up and down conversion for the coupled signals may be implemented in any of several well-known such processes and/or systems.

The beam processors 22 may be used to perform a wide variety of processing functions on the received signal. In a preferred embodiment the beam processors 22 may be caused to adaptively cancel interference in the received signal by implementing an adaptive cancellation algorithm. One example of a cancellation algorithm is the Gram-Schmidt algorithm, as well as many other alternatives. The processors may be programmed to implement an original algorithm or, they may be programmed to implement any one of a number of well known adaptive beam forming signal processing algorithms, such as and for example, the parametric estimator, the direct matrix inversion, the Kalman filter and, the maximum entropy method.

After being conditioned by the beam processors 22, the received signals may be coupled to one or more signal processing modules 52. In a preferred embodiment this coupling may be implemented through the use of a fiber optic network 50, which network may, as previously described in conjunction with coupling between the sub array outputs and the beam processors, be implemented in any known manner. The signal processing modules 52 can be used to perform additional processing upon the received signals. The signal processing modules 52 are in turn coupled to a set of microprocessors 54. Preferably, the signal processing modules and microprocessor will be implemented as Very High Scale Integrated Circuit (VHSIC) chips in order to obtain a high ratio of processing capability to unit volume. Any presently available VHSIC designs may be used or, where required, custom designed chips may be used.

The set of microprocessors 54 may be employed to control the operation of the beam processors 22 and may, as well, operate to control the overall operation of the system. In turn, the operation of such a microprocessor set may be controlled by an operator signal input to a microprocessor through a command line 58. Such signals may originate from either a human operator or another device. The microprocessor may also produce output data, via an output line 56, that can be reported to the system operator or used as an input to an additional processing stage, such as a computer. Such output data may contain system monitoring information as well as received target information.

In the transmit mode, microprocessors 54 may operate to communicate information about the desired transmission signal to the beam forming sub arrays 20, either directly or through the signal processing modules 52 and adaptive beam processors 22. Such information would be used by the beam forming sub arrays 22 to adjust the phase shifters 46 and attenuators 44 such that an RF signal applied to the sub array I/O ports 48 will be conditioned prior to amplification by the transceivers 14. Through appropriate selection of phase shifts and attenuations, the characteristics of the system's transmit signal can be readily controlled.

As in the receiving mode, communication of signals between the signal processors 52 and the adaptive beam processors 22, and between the adaptive beam processors 22 and the beam forming sub arrays 34, may be accomplished through fiber optic networks 50 and 26, respectively. Preferably, no additional fiber optic lines will be necessary, but rather multiplexers or other such devices will be employed so that both transmit and receive signals may be selectively communicated over the common fiber optic networks 50 and 26. Based on transmission information provided to the beam forming sub arrays 34, an RF signal, provided by the RF feed layer 32, will be inputted to the I/O port 48*a* of the beam forming sub arrays 34. This RF signal will drive each transmit channel of the T/R MMICS 40*a* through coupling network 40 and have its phase shifted by phase shifters and its amplitude attenuated by attenuators in each chip.

Figure 5:
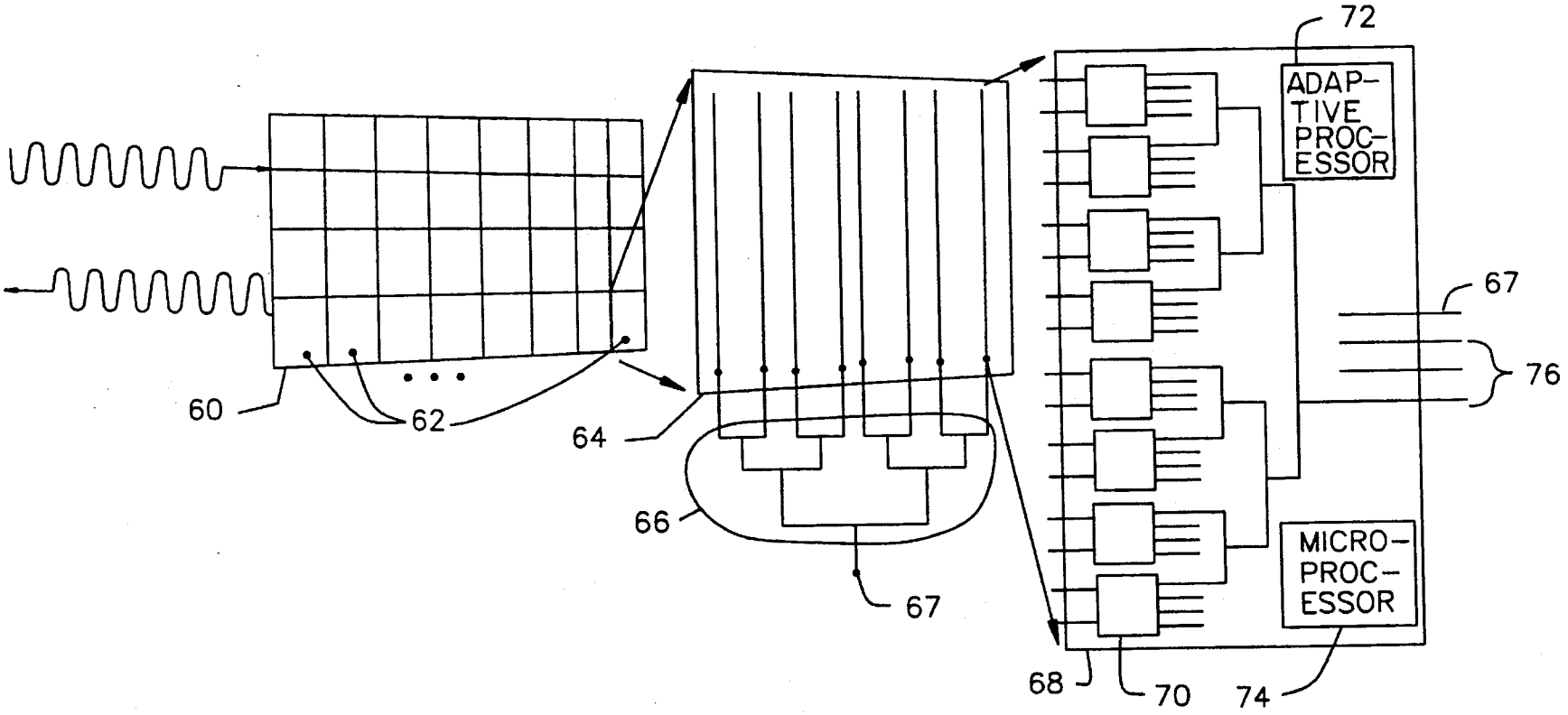
FIG. 5 is a schematic diagram of the integrated active array of the present invention as used in a phased array radar system.

Referring now to FIG. 5, there is shown a phased array system that integrates several coplanar sections 10 to form a higher level array. In the preferred embodiment of FIG. 5, an aperture 60 is formed by combining several sub-apertures 62. Each of the subapertures 62 may be in the form of two coplanar layers oriented in a manner similar to that depicted in the preferred embodiment of FIG. 2. The first layer may be composed of a 16× 16 array of antennas and the second layer may be composed of a 16×16 array of transceivers—each transceiver being coupled to a single antenna. The sub-apertures may then be affixed to each other or a connecting structure to form a larger aperture. For example, FIG. 5 shows an 8×4 array of sub-apertures combined to form an array of 128× 64 transceivers. An RF feed layer 64 is also shown in the embodiment of FIG. 5. This layer will function to combine received signals and divide transmit signals by means of a coupling network 66. The coupling network 66 will be coupled to a processing layer 68 and it may provide an output line 67 that will bypass the processing layer 68 and be used in conjunction with the output of that processing layer 68. Coupling between the aperture 60, RF feed layer 64, and the processing layer 68 may be accomplished through the use of microwave vias.

The processing layer 68 may include beam forming sub arrays 70, adaptive processor 72, microprocessor 74, and output lines 76. These elements cooperate in a manner similar to the that described and depicted in the embodiment of FIG. 2. The sub arrays 70 will be used to apply phase shift and attenuation to the received and transmitted signals, while the adaptive processor 72 may implement an interference cancellation algorithm. Both the sub arrays 70 and adaptive processor 72 may operate in response to inputs from the microprocessor 74. The output lines 76 will be used, in conjunction with the coupling network output 67, to relay information to a human operator or to another device.

As will be understood, the embodiment of FIG. 5 is meant to serve merely as an illustration of how several individual arrays, as depicted in FIG. 2, may be integrated into a larger array that is capable of being tailored to the size of the platform into which the array will be placed.

Herein, an active phased array antenna system containing single transceiver chips that are integrated in a manner that is coplanar to the face of the antenna, has been described. Although the present embodiment of the invention has been described in detail, it should be understood that various changes, alterations and substitutions can be made therein without departing from the spirit and scope of the invention as defined by the appended claims.

We claim:

1. An integrated active array antenna system, comprising:

a plurality of antenna elements through which electromagnetic energy is transmitted and received, said antenna elements forming a substantially planar antenna layer in a first plane having an inner surface and an outer surface on opposing sides;

a plurality of integrated circuit transceivers, each having an output coupled to at least one of said antenna elements, for transmitting and receiving electromagnetic energy to and from said antenna elements, each of said transceivers having an input port, said transceivers forming a transceiver layer in a second plane substantially parallel to said first plane, said transceiver layer having an outer surface facing said inner surface of said antenna layer;

combining means coupled to said transceivers and forming a combining layer in a third plane substantially parallel to said first and second planes, said combining layer having an outer surface facing said inner surface of said antenna layer, wherein said antenna layer, said transceiver layer and said combining layer are integrated together to form multiple layers of a sandwich style assembly, said combining means including at least one subarray, each said subarray including a coupling network of predetermined impedances, said coupling network having a plurality of output ports, with each output port coupled to the input port of at least one of said transceivers, wherein said combining means is operative to combine and divide signals passing through said transceivers; and a processing means for processing output signals from and input signals to said transceivers and for providing control signals to said system.

2. The integrated active array antenna system of claim 1, wherein each of said antenna elements comprise a thin metallic conductor bonded to a thin grounded dielectric substrate.

3. The integrated active array antenna system of claim 1, wherein each of said integrated circuit transceivers comprises a single chip Gallium Arsenide Monolithic Microwave Integrated Circuit.

4. The integrated active array antenna system of claim 1, wherein said coupling network has four separate output ports, each being individually coupled to a respective transceiver, each said subarray includes four separate input branches coupled to said coupling network;

wherein three of said four input branches include selectively variable attenuator and phase shifter means for conditioning signals therein, wherein said subarray in conjunction with said transceivers and said antenna elements is operable to form four beams with three of said four beams being conditioned and offset at an angle from a fourth unconditioned reference beam from said subarray, thereby allowing for two axis monopulse angle measurement for location of a target.

5. The integrated active array antenna system of claim 1, wherein said processing means is coupled to said system via a fiber optic transmission means.

6. The integrated active array antenna system of claim 1, further including:

a cooling membrane positioned between said antenna layer and said transceiver layer, wherein said cooling membrane is oriented coplanar to said layer of transceivers.

7. The integrated active array antenna of claim 1, further including a planar RF feed layer substantially parallel to, and integrated with, said antenna, transceiver and combining layers, thereby forming a separate layer of said sandwich style assembly.

8. The integrated active array antenna system of claim 1, further including:

a planar DC feed layer substantially parallel to, and integrated with, said antenna, transceiver, and combining layers thereby forming a separate layer of said sandwich style assembly.

9. The integrated active array antenna system of claim 1, further including:

a radome layer positioned adjacent to the outer surface of said antennas.

10. The integrated active array antenna system of claim 1, wherein said processing means includes an adaptive beam processor that operates to implement an adaptive cancellation technique, said adaptive beam processor being implemented in a layer that is oriented coplanar to said layer of transceivers.

11. The integrated active array antenna system of claim 10, further including:

a signal processor for sending control signals to said adaptive beam processor and for receiving processed signals from said adaptive beam processor; and a signal channeling means for connecting said signal processor to said adaptive beam processor.

12. The integrated active array antenna system of claim 11, wherein said signal channeling means for connecting said signal processor to said adaptive beam processors is implemented via a fiber optic transmission means.

13. The integrated active array antenna system of claim 12, wherein said signal processor includes:

a microprocessor; and a plurality of dedicated signal processing modules coupled to said microprocessor.

14. The integrated active array antenna system of claim 13, wherein said microprocessor and said dedicated signal processing modules are implemented as Very High Scale Integrated Circuit chips.

15. The integrated active array antenna system of claim 10, wherein said adaptive cancellation technique is selected from the group consisting of Gram-Schmidt algorithm, parametric estimator algorithm, direct matrix inversion algorithm, Kalman filter algorithm, and maximum entropy algorithm.

16. An integrated active array antenna system, comprising:

a plurality of antenna elements through which electromagnetic energy is transmitted and received, said antenna elements forming an antenna layer in a first plane, said antenna layer having an inner surface and an outer surface on opposite sides;

a plurality of transceivers, each formed as a single monolithic microwave integrated circuit (MMIC) chip, said transceivers coupled to said antenna elements for transmitting and receiving electromagnetic energy, said transceivers forming a transceiver layer in a second plane substantially parallel to said first plane and having an outer surface facing said inner surface of said antenna layer;

at least one subarray means coupled to said plurality of transceivers for forming multiple beam patterns, said subarray means including a coupling network of predetermined impedances for selectively combining signals from multiple ones of said plurality of said transceivers, said sub-array means being oriented in a third plane substantially parallel to said first, and second planes and forming an additional layer, wherein said antenna layer, said transceiver layer and said additional layer are integrated together to form multiple layers of a sandwich style assembly, each of said at least one sub-array also being formed as a single MMIC chip; and processing means for processing output signals from, and input signals to said plurality of transceivers, and for providing control signals to said system.

17. The integrated active array antenna system of claim 16, wherein said processing means is coupled to said system via a fiber optic transmission means.

18. The integrated active array antenna system of claim ,16, further including:

a cooling membrane positioned between said antenna layer and said transceiver layer.

19. A method of constructing substantially planar integrated active array antenna system, comprising the steps of:

forming an antenna layer consisting of a plurality of antenna elements arranged in a planar geometry;

forming a transceiver layer having a plurality of integrated circuit transceiver chips arranged in a planar geometry, said transceiver chips operative for transmitting and receiving electromagnetic energy through said antenna elements, each of said transceiver chips having an input port;

forming a combining layer including at least one subarray operable to combine and divide signals passing through said transceiver chips, each said subarray including a coupling network having a plurality of output ports with each output port coupled to at least one input port of said transceiver chips; and affixing said antenna, transceiver, and combining layers to one another in a sandwich type configuration, with each of said antenna layer, said transceiver layer and said combining layer as one layer of said sandwich type configuration.

20. The integrated active array antenna of claim 16, wherein said sub array means includes four separate input branches coupled to said coupling network, said coupling network includes four separate transceiver ports each coupled to a respective transceiver, wherein three of said four input branches include selectively variable attenuator and phase shifter means for conditioning signals therein, wherein said subarray means, in conjunction with said transceivers and said antenna elements, is operative to form four beams with three of said four beams being conditioned and offset at an angle from a fourth unconditioned reference beam, thereby providing for two axis monopulse angle measurement for location of a target.

21. The integrated active array system according to claim 1 wherein said transceiver layer is between said antenna layer and said combining layer.

* * * * *